United States Patent [19]

Hottenroth et al.

[11] 3,982,522

[45] Sept. 28, 1976

[54] PORTABLE FORCED DRAFT COOKER

[76] Inventors: Fred W. Hottenroth, 1740 Interlachen St., Seal Beach, Calif. 90740; Fred W. Hottenroth, III, 3415 Lama Ave., Long Beach, Calif. 90808

[22] Filed: Mar. 31, 1975

[21] Appl. No.: 563,842

[52] U.S. Cl. ..... 126/2; 126/25 R; 126/146

[51] Int. Cl.[2] ..... F23M 3/18

[58] Field of Search ..... 126/9 R, 25, 146, 2, 126/3, 290, 15 A, 111; 110/1 F

[56] References Cited

UNITED STATES PATENTS

| | | | |
|---|---|---|---|
| 747,100 | 12/1903 | Stockon | 126/2 |
| 964,502 | 7/1910 | Drummond | 126/146 |
| 2,210,720 | 8/1940 | Johnson et al. | 126/25 B |
| 3,060,868 | 10/1962 | MacLachlan | 126/25 B |
| 3,152,585 | 10/1964 | Harrison | 126/2 |
| 3,279,452 | 10/1966 | Hottenroth et al. | 126/25 R |
| 3,868,943 | 3/1975 | Hottenroth et al. | 126/9 R X |

FOREIGN PATENTS OR APPLICATIONS

| | | | |
|---|---|---|---|
| 1,285,540 | 1/1962 | France | 126/25 |

*Primary Examiner*—William E. Wayner
*Assistant Examiner*—Harold Joyce
*Attorney, Agent, or Firm*—William C. Babcock

[57] ABSTRACT

A portable forced draft solid fuel burning cooker in which a duct defining base supports a centrally disposed electrically operated blower unit. Two heater units that use fuel such as briquets, acorn, small pieces of wood, twigs and the like are supported from the base on opposite sides of the blower unit. First and second manually operated dampers are provided in the base to selectively permit a desired volume of air from the blower to flow to either the first or second heater unit, or concurrently to both units. Individual cooking utensils may be heated to different temperatures on the first and second heater units if desired, by controlling the volume of air flowing to each of the heater units. A heat conducting grill may be extended across both heater units, and utilized to cook pancakes and the like.

6 Claims, 5 Drawing Figures

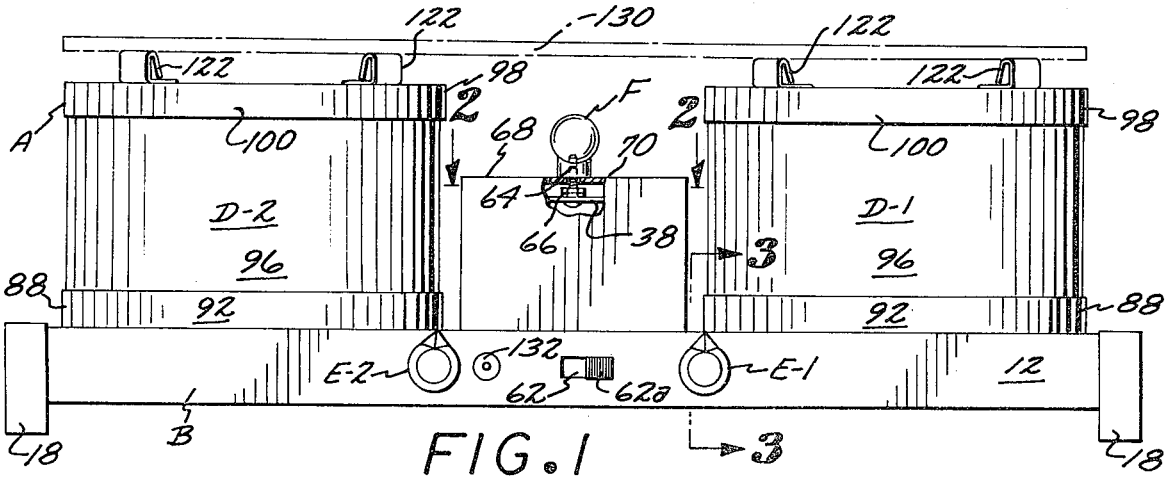
FIG. 1
FIG. 2
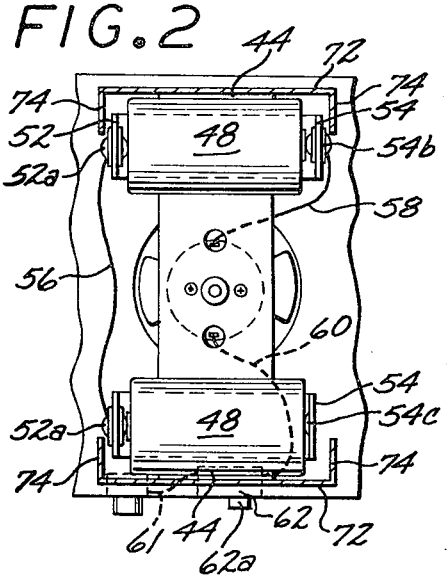
FIG. 3
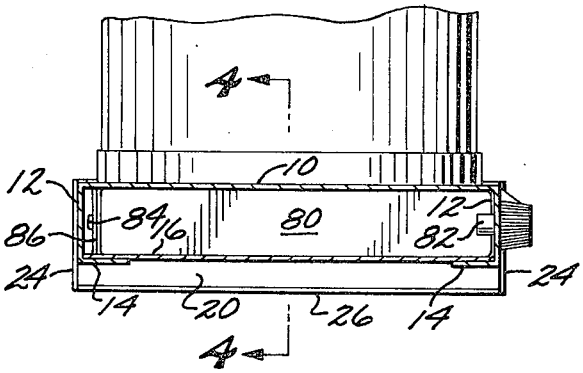
FIG. 5
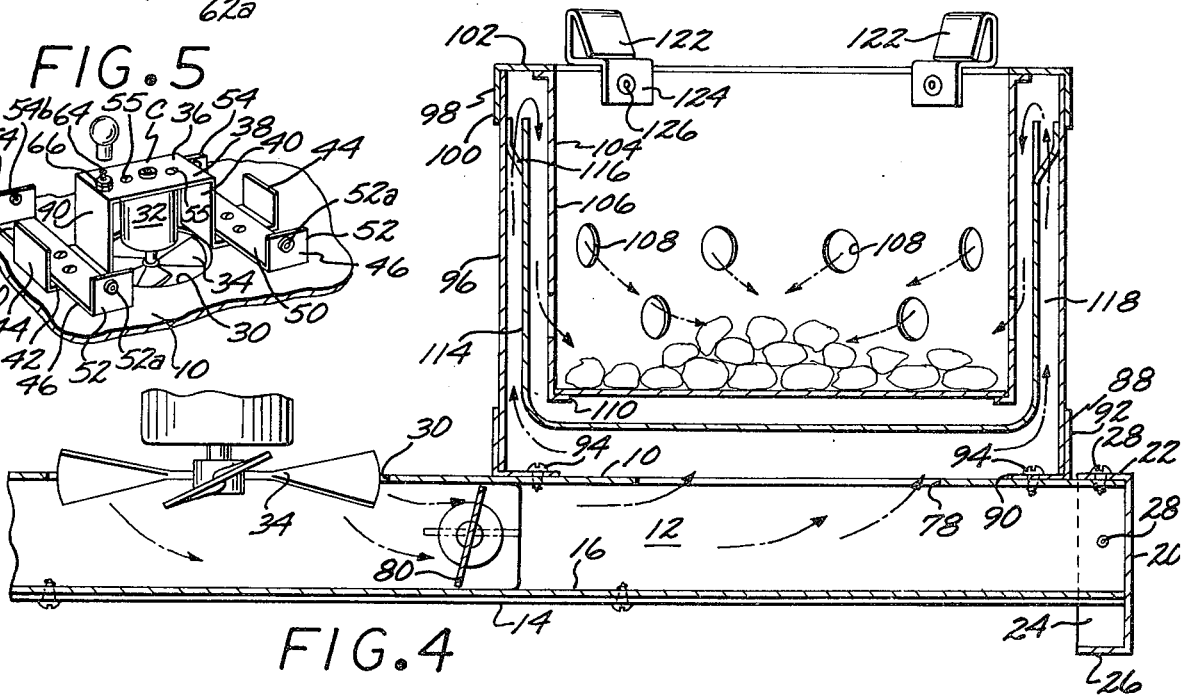
FIG. 4

PORTABLE FORCED DRAFT COOKER

BACKGROUND OF THE INVENTION

1. Field of the Invention

A portable forced draft cooker.

2. Description of the Prior Art

In the past, a number of forced draft, solid fuel burning cookers have been designed and used, but these devices provide heating for a single vessel or a container, and as a result such devices have but limited use in cooking.

The primary object in devising the present invention is to supply a cooker in which a duct defining base has an electrically operated blower unit centrally disposed thereon, and a draft operated heating unit situated on each side of the blower unit and supported from the base. First and second manually operable dampers are included as a part of the base structure, and permit a desired volume of air to flow from the blower through the ducts in the base to either a desired one of the heater units, or to both. Control of the volume of air flowing to the heater unit permits a container or vessel to be heated to a desired temperature on one of the units, and as a result the invention may be used to concurrently cook food in first and second vessels at different temperatures. If desired, a flat heat conducting grill may be deposited to span both of the heater units, and by directing equal quantities of air to the two heater units, the grill may be heated to a uniform temperature to permit the cooking of pancakes and the like thereon.

SUMMARY OF THE INVENTION

A light weight, forced draft, solid fuel burning cooker that includes an elongate duct defining base that supports a centrally disposed blower unit. The blower unit when operating directs a stream of air into the interior of the base.

The base supports first and second draft operated heater units on opposite sides of the blower, and by the use of first and second manually controlled dampers, the first and second units may be selectively supplied air from the blower unit in desired quantities to heat vessels on the heater units to different temperatures.

The heater unit may be used either singularly or in unison. By supporting the same volume of air to both heater units, the heater units will each supply substantially the same amount of heat, and as a result a flat heat conducting grill may be heated to a substantially uniform temperature when supported by both of the heater units. Such a grill may be used for cooking pancakes and the like.

After the cooking operation is completed, the cooker is inverted to discharge unburned fuel therefrom. The blower unit may then be actuated to cool the heater units to the extent that the cooker may be packed into a confined space for storage or transportation without danger of igniting other articles or clothing situated in the space.

BRIEF DESCRIPTION OF THE DRAWING

FIG. 1 is a side elevational view of the invention;

FIG. 2 is a fragmentary, horizontal cross-sectional view of the device taken on line 2—2 of FIG. 1;

FIG. 3 is a fragmentary, vertical, transverse cross-sectional view of the invention taken on the line 3—3 of FIG. 1;

FIG. 4 is a fragmentary longitudinal cross-sectional view of the invention taken on the line 4–4 of FIG. 3; and FIG. 5 is a perspective view of the blower unit.

DESCRIPTION OF THE PREFERRED EMBODIMENT

A portable forced draft solid fuel burning cooker A as may be seen in the drawings includes an elongate hollow duct defining base B. The base B at substantially the center thereof supports an electrically operated blower assembly C. First and second identical heater assemblies D-1 and D-2 that are actuated by a draft are located on opposite sides of the blower assembly C and supported on the base B. The base B rotatably supports first and second handles E-1 and E-2 that are operatively associated with dampers situated within the confines of the base to regulate the volume of air flowing to the first and second heaters D-1 and D-2. The quantity of air flowing to the first and second heater assemblies D-1 and D-2 controls the rapidity with which fuel is burned therein and the quality of heat emitted from the heater assemblies for cooking purposes.

The base B as may best be seen in FIGS. 1, 3 and 4 include an upper rectangular top piece 10 that has side pieces 12 extending downwardly from the longitudinal edges thereof, and the side pieces 12 on the lower edges thereof developing into flanges 14 that extend inwardly toward one another. An elongate rectangular bottom piece 16 is provided that rests on the upper surfaces of the flange 14 and is secured thereto by conventional means (not shown), such as screws, tack welding or the like. The base B includes end pieces 18 as may best be seen in FIG. 1, with each end piece including an end wall 20, upper flange 22, a pair of side flanges 24, and a bottom flange 26. The end pieces 18 are of substantially greater depth than the distance between the top piece 10 and bottom piece 16, and as a result the end pieces 18 support the base B substantial distance above the surface on which the cooker A is supported. The end pieces 18 are secured to the base B by screws or other fastening means 28 that extend through the upper flange 22 and side flanges 24 to engage the top piece 10 and side pieces 12 as may best be seen in FIG. 4.

The rectangular top piece 10 of base B has a centrally disposed opening 30 therein as may be seen in FIG. 4 and above which opening an electric motor 32 is situated that drives a bladed fan 34. The fan 34 is so disposed that as it is rotated a stream of air is directed downwardly into the interior of the base B.

The blower assembly C as best seen in FIG. 5 includes an inverted channel shaped member 36 that includes a horizontal web 38 that has a pair of first flanges 40 extending downwardly from the ends thereof. The first flanges 40 on their lower ends develop into oppositely extending horizontal legs 42, which legs on their outer extremities develop into second upwardly extending flanges 44. Two longitudinally extending laterally spaced cradles 46 for batteries 48 are provided, with a pair of cradles being situated on opposite sides of the channel shaped member 36.

Each of the battery cradles 46 as may be seen in FIG. 5 includes a longitudinally extending member 50 that has first and second end pieces 53 and 54 respectively extending upwardly therefrom. The two first end pieces 52 have first insulated terminals 52*a* mounted thereon. One of the second end pieces 54 has a second insulated terminal 54*b* secured thereto, and the other second end piece 54 has a third terminal 54*c* mounted thereon which is in electrical communication with the end piece.

The motor 32 is supported in a depending position from the web 38 by conventional means 55. In FIG. 2 will be seen a first electrical conductor 56 is provided that extends between the two terminals 52*a*. A second electrical conductor 58 is provided that is connected to the second terminal 54*b* and to a first terminal of electric motor 32. A third electrical conductor 60 extends from the opposite terminal of the electric motor 32 to one terminal of a normally opened electric switch 32 that is mounted on the base B as shown in FIG. 1. A fourth electrical conductor 61 extends from the other terminal of the electric switch and is grounded to the metal defining channel shaped member 36, and the third terminal 54*c* is likewise grounded to the channel shaped member.

When the switch 62 is placed in a closed position by use of a handle 62*a* that forms a part thereof, the electric motor 32 is energized to drive the bladed fan 34. The horizontal web as can be seen in FIG. 5 has a screw 64 extending upwardly therethrough, which screw above the web is engaged by a pair of lock nuts 66 to hold the screw in a fixed position on the web.

A housing 68 is provided that includes a horizontal rectangular sheet 70 that has a pair of end pieces 72 projecting downwardly from the ends thereof. The sheet 70 and end pieces 72 are so formed as to define flanges 74 along the longitudinal edges thereof.

The horizontal sheet 70 has an opening 76 therein through which the screw 64 extends upwardly when the housing 68 is mounted on the base B as shown in FIG. 1. A handle F is provided as may be seen in FIGS. 1 and 5 that has an internally tapped opening therein (not shown), that threadedly engages the screw 64 to removably hold the housing 68 in position on base B as shown in FIG. 1.

Two openings 78 of substantial diameter are formed in the upper rectangular top piece 10 on opposite sides of the opening 30, one of which openings 78 is shown in FIG. 4. First and second identical dampers 80 are provided, one of which is shown in FIG. 4, with each damper being intermediately disposed between the opening 30 and one of the openings 78. Each of the dampers 80 is in the form of a rectangular plate that first and second stub shaft 82 and 84 extending outwardly from opposite ends thereof. The first stub shafts 82 are rotatably supported in one of the side pieces 12, and have the first and second handles E-1 and E-2 secured to the outwardly projecting portions of the shafts. The second stub shafts 84 are journaled in openings formed in a wall 86 that is situated within the interior of the base B, and extends between the upper top piece 10 and bottom piece 16 as can best be seen in FIG. 3.

Two first rings 88 are secured to the upper surface of the top piece 10 as may be seen in FIG. 1, and extend around the openings 78 formed therein. Each of the first rings 88 include an annular shaped web 90 as may best be seen in FIG. 4 that has a cylindrical side wall 92 extending upwardly therefrom. Each of the webs 90 is secured to the top piece 10 by screws 94. Each of the side walls 92 has a first cylindrical shell 96 extending upwardly therefrom as shown in FIGS. 1 and 4.

Each of the first cylindrical shells 96 has a second ring 98 mounted on the upper end thereof, which second ring includes a cylindrical side wall 100 and an inwardly extending annular shaped web 102. The interior peripheral edge portion of each web 102 has a second cup shaped shell 104 secured thereto and depending therefrom. Each of the second shells 104 includes a cylindrical side wall 106 having a number of spaced openings 108 therein, and each second shell 104 developing on the lower end thereof into an inwardly extending lip 110 that serves to support a bottom 112 as shown in FIG. 4.

Two third cup shaped shells 114 are provided and are intermediately disposed between the first shells 96 and second shells 104, and the first, second and third shells cooperating to define a first passages 118 that are in communication with the openings 78, and a second passage 120 that are in communication with openings 108 in the second shells 104. A number of circumferentially spaced clips 122 are welded or otherwise secured to the upper surface of the webs 102 as shown in FIGS. 1 and 4, with the clips including downwardly extending legs 124 that are secured by rivets 126 to the upper portion of the second shell 106.

The use and operation of the invention is extremely simple. The first and second heater assemblies D-1 and D-2 have fuel 128 placed therein. The single electrically operated blower assembly C serves to provide an air draft for both the first and second heater assemblies D-1 and D-2. The amount of air furnished by the blower assembly C to each of the first and second heater assemblies D-1 and D-2 is controlled by manually adjusting the handles E-1 and E-2 to pivot the two dampers 80 that are intermediately disposed between the fan 34 and the first and second heater assemblies D-1 and D-2.

The batteries 48 are installed in the supporting cradles 46 by unscrewing the handle F to permit the housing 68 to be lifted upwardly out of contact with the second flanges 44. After the batteries 48 are installed as shown in FIG. 2, the housing is mounted on the base B as illustrated in FIG. 1, with the handle F then being rotated into threaded engagement with the screw 64. The handle F serves to hold the housing 68 in position on base B, as well as to permit the cooker A to be moved from place to place.

The fuel 128 is ignited with a match, and after the fuel starts to burn switch 62 is placed in the closed position by moving handle 62*a* to an appropriate position. Closing of the switch 62 energizes the motor 32 to drive the fan 34, and the fan 34 as it rotates directing a stream of air downwardly into the interior of the base B. The quantity of air flowing to the first and second heater assemblies D-1 and D-2 is regulated by rotating the handles E-1 an E-2 to control the position of the dampers 80. After the fuel 128 is burning, the blower assembly is turned off by moving the switch handle 62*a* to an appropriate position. Minimizing use of the blower assembly extends the life of the batteries 48.

The heat emitted by the first and second heater assemblies D-1 and D-2 may also be controlled by adjusting the quantity of fuel in each of the assemblies. After the device A has served its purpose, and the cooking operation is completed, the device is lifted by the handle F, and the remaining unburned fuel 128 discharged therefrom to a safe place such as on the ground. If the unburned fuel is discharged on to the ground it may be thoroughly extinguished by water being poured thereon or the fuel being buried in the ground. After the unburned fuel has been discharged from the device the switch handle 62*a* is positioned to energize the motor 32, with air from the blower assembly now being directed upwardly around the first, second and third shells of the heater assemblies D-1 and D-2 to cool the same. When the device A is used for cooking, the air stream generated by rotation of the fan 34 flows upwardly through the openings 78 and through the first and second passages 118 and 120, with the air being preheated prior to being blown over the fuel 128 as indicated by the arrows as shown in FIG. 4.

The heater assemblies D-1 and D-2 operates in the same manner as the heater described in our copending application Ser. No. 481,500, filed June 21, 1974. Should it be desired to cook food products such as pancakes or the like, a grill 130 may be rested on the upper surfaces of the clips 122 as shown in FIG. 1, with equal quantities of air being discharged to the two heater assemblies D-1 and D-2 to heat the grill 130 uniformly.

The third shell 114 is illustrated as being supported in an intermediate position between first and second shells 96 and 106 by use of the clips 116. However, should it be desired the third shell 114 may be supported in this intermediate position by clips as shown in FIG. 5 of our co-pending U.S. patent application Ser. No. 481,500. An electrical connection 132 is provided adjacent switch 62 as shown in FIG. 1 to permit the device A to be thermostatically controlled if desired.

We claim:

1. A portable forced draft solid fuel burning cooker that includes:

a. a hollow duct defining elongate base having a top piece, said top piece having a central opening therein, and first and second openings on opposite sides of said central opening;

b. an electrically operated blower assembly mounted on said top piece, said blower assembly when electrically energized directing a stream of air through said central opening into the interior of said base;

c. manually operated switch means for turning said blower assembly on and off;

d. first and second pivotally supported dampers inside said base and intermediately disposed between said central opening and first and second openings for controlling the quantity of air flowing to said first and second openings when said blower assembly is electrically energized;

e. first and second heater assemblies mounted on said top piece above said first and second openings, each of said heater assemblies including an outer cylindrical shell secured to said top piece and in communication with the one of said first and second openings most adjacent thereto, a second inner cup shaped shell in which solid fuel is disposed, a ring that joins free peripheral edges of said first and second shells, said second shell of substantially less transverse area than said first shell and said first and second shells cooperating with said ring to define a confined space of annulus shape, a third cup shaped shell interposed in a fixed position between said first and second shells that subdivides said confined space into an outer first passage and an inner second passage in which air flowing thereto from said blower assembly is preheated by the combustion of said fuel prior to discharging across said fuel from a plurality of spaced openings in said second shell to support the combustion of said fuel, and first means for supporting said third cup shaped shell in a fixed position between said first and second shells; and f. first and second handles operatively associated with said first and second dampers to control the position of the latter and regulate the quantity of air flowing from said blower assembly to said first and second heater assemblies.

2. A cooker as defined in claim 1 in which said first means are a plurality of circumferentially spaced clips secured to the interior surface of said first shell and the exterior surface of said third shell.

3. A cooker as defined in claim 1 in which said blower assembly includes:

g. an electric motor;

h. a fan driven by said motor and so disposed as to direct a stream of air downwardly through said control opening into the interior of said base;

i. at least one battery;

j. electrical conducting means connecting said battery to said motor and said switch means; and k. a second means for supporting said motor, fan, battery and electrical conducting means in a fixed position relative to said top piece.

4. A cooker as defined in claim 3 in which said second means includes:

l. an inverted channel shaped member that includes a web disposed above said top piece and over said central opening, a pair of first flanges extending downwardly from the ends of said web, a pair of legs extending outwardly in opposite directions from the ends of said first flanges most adjacent said top piece, and a pair of second flanges extending upwardly from the portions of said legs most remote from said first flanges;

m. third means for securing said legs to said top piece;

n. fourth means for supporting said motor in a depending position from said web; and o. a pair of longitudinally extending, laterally spaced cradles for a pair of batteries supported from said legs between said first and second flanges.

5. A cooker as defined in claim 4 which in addition includes:

p. a housing that encloses said second means; and q. fifth means for removably securing said housing to said second means.

6. A cooker as defined in claim 5 in which said fifth means is of such structure as to serve as a handle to lift said cooker and move the latter.

* * * * *